US010624420B2

(12) United States Patent
Keating et al.

(10) Patent No.: US 10,624,420 B2
(45) **Date of Patent: *Apr. 21, 2020**

(54) ARTICLE OF FOOTWEAR, ELEMENTS THEREOF, AND RELATED METHODS OF MANUFACTURING

(71) Applicant: K-SWISS, INC., Los Angeles, CA (US)

(72) Inventors: Brian Keating, West Hills, CA (US); David Bond, Newbury Park, CA (US)

(73) Assignee: K-SWISS, INC., Los Angeles, CA (US)

( * ) Notice: Subject to any disclaimer, the term of this patent is extended or adjusted under 35 U.S.C. 154(b) by 201 days.

This patent is subject to a terminal disclaimer.

(21) Appl. No.: 15/468,544

(22) Filed: Mar. 24, 2017

(65) Prior Publication Data

US 2017/0196307 A1 Jul. 13, 2017

Related U.S. Application Data

(63) Continuation of application No. 14/037,977, filed on Sep. 26, 2013, now Pat. No. 9,622,540.
(Continued)

(51) Int. Cl.
*A43B 13/18* (2006.01)
*A43B 23/22* (2006.01)
(Continued)

(52) U.S. Cl.
CPC ..... *A43B 13/183* (2013.01); *A43B 13/04* (2013.01); *A43B 13/12* (2013.01); *A43B 13/122* (2013.01);
(Continued)

(58) Field of Classification Search
CPC ..... A43B 13/18; A43B 13/181; A43B 13/183; A43B 13/184; A43B 13/12; A43B 23/22;
(Continued)

(56) References Cited

U.S. PATENT DOCUMENTS 324,065 A 8/1885 Andrews
857,816 A 6/1907 Luzzi
(Continued)

FOREIGN PATENT DOCUMENTS

CN 1057765 A 1/1992
CN 1688221 A 10/2005
(Continued)

OTHER PUBLICATIONS

Office Action dated Jan. 19, 2017 in corresponding German Patent Application No. 10 2014 101 032.9 (with an English translation) (15 pages).
(Continued)

*Primary Examiner* — Jameson D Collier
*Assistant Examiner* — Jocelyn Bravo
(74) *Attorney, Agent, or Firm* — Rothwell, Figg, Ernst & Manbeck, P.C.

(57) ABSTRACT

A shank for an article of footwear including a substantially planar base portion extending within a first plane in the longitudinal and lateral directions and a substantially planar ramp portion designed to absorb footwear loads in a vertical direction, the ramp portion extending, in an uncompressed state, within a second plane that is oblique to the first plane. The base portion and the ramp portion are arranged such that they do not overlap in the vertical direction. A sole assembly is also described and includes an outsole divided into a first portion located at a forefoot portion of the sole assembly and a second portion located at an arch portion of the sole assembly. The second portion is designed to contact the midsole in a compressed state and form a gap between when a load is removed. Related methods of manufacturing are also described.

13 Claims, 15 Drawing Sheets

Related U.S. Application Data

(60) Provisional application No. 61/833,808, filed on Jun. 11, 2013.

(51) Int. Cl.
*A43B 13/12* (2006.01)
*A43B 13/04* (2006.01)
*A43B 13/22* (2006.01)

(52) U.S. Cl.
CPC ..... *A43B 13/184* (2013.01); *A43B 13/186* (2013.01); *A43B 13/188* (2013.01); *A43B 13/223* (2013.01); *A43B 23/22* (2013.01); *A43B 23/227* (2013.01)

(58) Field of Classification Search
CPC ..... A43B 23/227; A43B 13/04; A43B 13/122; A43B 13/186; A43B 13/223
USPC ..... 36/27, 102, 30 R, 103
See application file for complete search history.

(56) References Cited

U.S. PATENT DOCUMENTS 1,107,894 A 8/1914 Cain
1,387,411 A * 8/1921 Kolkebeck ..... A43B 7/142 36/76 R
1,399,153 A 12/1921 Rogers
1,403,970 A 1/1922 Lioy
1,484,785 A 2/1924 Hiss
1,714,670 A 5/1929 Hiss
2,219,419 A 10/1940 Jacobus
2,385,273 A 9/1945 Hilton
2,551,161 A 5/1951 Repice
3,142,910 A 8/1964 Levine
3,835,558 A 9/1974 Revill
4,492,046 A 1/1985 Kosova
4,566,206 A 1/1986 Weber
4,592,153 A 6/1986 Jacinto
5,381,608 A 1/1995 Claveria
5,396,718 A 3/1995 Schuler et al.
5,435,079 A 7/1995 Gallegos
5,826,350 A 10/1998 Wallerstein
5,875,567 A 3/1999 Bayley
5,896,679 A 4/1999 Baldwin
6,009,636 A 1/2000 Wallerstein
6,029,374 A 2/2000 Herr et al.
D434,548 S 12/2000 Gallegos
6,775,930 B2 * 8/2004 Fuerst ..... A43B 13/026 12/146 B
7,100,308 B2 9/2006 Aveni
7,434,337 B2 * 10/2008 Gibert ..... A43B 3/0052 36/25 R
7,788,824 B2 * 9/2010 Hann ..... A43B 13/20 36/102
7,832,117 B2 11/2010 Auger et al.
7,886,460 B2 * 2/2011 Teteriatnikov ..... A43B 13/145 36/25 R
8,056,262 B2 11/2011 Lindqvist et al.
8,186,081 B2 5/2012 Wilson, III et al.
2002/0112373 A1 8/2002 Talbott
2002/0133977 A1 9/2002 Pan
2005/0000115 A1 1/2005 Kimura et al.
2005/0102857 A1 5/2005 Yen
2005/0268488 A1 * 12/2005 Hann ..... A43B 13/20 36/27
2006/0010715 A1 1/2006 Tseng et al.
2006/0048411 A1 3/2006 Lindqvist et al.
2006/0137219 A1 6/2006 Xavier et al.
2006/0137228 A1 6/2006 Kubo et al.
2006/0201028 A1 9/2006 Chan et al.
2007/0199210 A1 8/2007 Vattes et al.
2007/0256326 A1 11/2007 Jarvis
2007/0295451 A1 12/2007 Willis
2008/0148598 A1 6/2008 Schoenborn
2008/0263900 A1 10/2008 Determe et al.
2008/0289220 A1 11/2008 Rivas et al.
2009/0056165 A1 3/2009 Lee
2009/0077830 A1 * 3/2009 Lee ..... A43B 13/10 36/108
2009/0151201 A1 6/2009 Lee
2009/0193682 A1 8/2009 Rosenbaum
2009/0320330 A1 12/2009 Borel et al.
2010/0263234 A1 * 10/2010 Teteriatnikov ..... A43B 13/145 36/108
2010/0269368 A1 10/2010 Nakatsuka
2010/0293811 A1 11/2010 Truelsen
2010/0293816 A1 * 11/2010 Truelsen ..... A43B 5/06 36/30 R
2010/0307025 A1 12/2010 Truelsen et al.
2011/0023328 A1 2/2011 Testa et al.
2011/0030245 A1 2/2011 Truelsen
2011/0047827 A1 3/2011 Diekman
2011/0061264 A1 3/2011 Solymosi et al.
2011/0061265 A1 3/2011 Lyden
2011/0154693 A1 6/2011 Oberschneider
2011/0179669 A1 7/2011 Hanebrink et al.
2011/0185593 A1 8/2011 Ramos
2012/0030971 A9 2/2012 Truelsen
2012/0159814 A1 6/2012 Smith et al.
2012/0167412 A1 7/2012 Braunschweiler
2012/0186107 A1 7/2012 Crary et al.
2012/0216424 A1 8/2012 Lyden
2012/0246969 A1 * 10/2012 Baum ..... A43B 13/183 36/27
2012/0285040 A1 11/2012 Sievers
2012/0324760 A1 12/2012 Ochoa
2013/0067765 A1 3/2013 Auger et al.
2013/0192090 A1 8/2013 Smith, IV
2013/0219748 A1 8/2013 Dombrow et al.
2013/0219752 A1 8/2013 Dombrow et al.
2013/0232826 A1 9/2013 Bier et al.
2014/0000125 A1 1/2014 Butler
2014/0041253 A1 2/2014 Rabushka
2014/0047740 A1 2/2014 Tucker et al.
2014/0230280 A1 8/2014 Heard et al.
2014/0259788 A1 9/2014 Dojan et al.
2014/0305005 A1 10/2014 Yeh
2015/0026996 A1 * 1/2015 Baum ..... A43B 13/183 36/27
2015/0047229 A1 2/2015 Elliott et al.
2015/0075029 A1 3/2015 Christensen et al.
2015/0089834 A1 * 4/2015 Baum ..... A43B 13/183 36/27
2015/0107133 A1 4/2015 Ganuza et al.

FOREIGN PATENT DOCUMENTS

CN 203137250 U 8/2013
DE 41 22 086 A1 1/1992
DE 698 31 947 T2 7/2006
JP 2009-106694 A 5/2009
JP 2009-153990 A 7/2009
JP 2011-255143 A 12/2011
JP 2013-99491 A 5/2013
KR 1994-0003163 B1 4/1994
WO 02/060291 A1 8/2002

OTHER PUBLICATIONS

Notification of Second Office Action dated May 12, 2016 in corresponding Chinese Patent Application No. 201310589788.X (with an English translation) (23 pages).
Notification of First Office Action dated Sep. 18, 2015 in corresponding Chinese Patent Application No. 201310589788.X (with an English translation) (23 pages).
Search Report under Section 17(5) dated May 21, 2014 in corresponding GB Application No. 1320496.1 (4 pages).
Notification of First Office Action dated May 2, 2017 in corresponding Chinese Patent Application No. 201610325661.0 (with an English translation) (23 pages).

(56) References Cited

OTHER PUBLICATIONS

Notification of Reasons for Refusal dated Sep. 12, 2017 in corresponding Japanese Patent Application No. 2013-229988 (with an English translation) (8 pages).
Korean Office Action issued in Application No. 10-2013-0134049, dated Aug. 21, 2019, with English Translation (11 pages).

* cited by examiner

ARTICLE OF FOOTWEAR, ELEMENTS THEREOF, AND RELATED METHODS OF MANUFACTURING

CROSS REFERENCE TO RELATED APPLICATION

This application is a Continuation of and is based upon and claims the benefit of priority to co-pending U.S. application Ser. No. 14/037,977, filed Sep. 26, 2013, and U.S. Provisional Application No. 61/833,808, filed Jun. 11, 2013. The entire contents of each of the above applications are incorporated herein by reference.

BACKGROUND

Field

This invention relates to articles of footwear, elements thereof, and related methods of manufacturing.

Description of the Related Art

In many types of footwear, the lower or underfoot portion of the footwear can include a midsole that is directly attached to an upper. The midsole can be designed primarily to provide stability for the foot and/or attenuate shock. An outsole can be attached to the midsole and is often designed to resist wear and provide traction.

When running and walking, generally a wearer's foot makes initial contact with the ground surface on the lateral portion of the heel area. At initial contact, runners typically strike the ground at a force of 2.5 times their body weight, which may be repeated at a rate of 180 times per minute (90 times per minute for each foot). Footwear is thus often designed such that its sole has a desired firmness and/or resiliency to provide for a desired impact cushioning.

BRIEF SUMMARY

Modern footwear is a combination of elements, which can cooperatively interact to reduce weight, while increasing comfort, cushioning, stability and durability. However, these goals are sometimes in conflict with each other, and as a result, in an effort to achieve one of these objectives, a deleterious effect on one or more other goals can occur.

The cushioning in most athletic shoes can be supplied through a foam midsole that may provide ample cushioning when new, but can have a tendency to lose some of its cushioning ability over time due to failure of the structured materials by the application of repeated shear and vertical forces. One trend in the footwear industry is towards thickening the midsoles of athletic shoes to enhance the cushioning effect of the sole. An added thickness of foam, however, can cause the sole to have an undesired stiffness in bending or other undesirable characteristics. The footwear described herein can provide a number of advantageous features that can be utilized alone or in combination. For example, by providing improved cushioning, stability, and/or elastic spring arrangements within the footwear, the footwear can be tailored to the forces to which that portion of the shoe is subjected while meeting the demands of shock absorption, comfort and stability.

In some embodiments, a shank for an article of footwear can include a substantially planar base portion extending within a first plane in the longitudinal and lateral directions, a substantially planar ramp portion designed to absorb footwear loads in a vertical direction, the ramp portion extending, in an uncompressed state, within a second plane that is oblique to the first plane. The base portion and the ramp portion can be arranged such that they do not overlap in the vertical direction. In some embodiments, footwear can include an upper designed to receive an upper portion of a user's foot, an outsole coupled to the upper and designed to engage with a ground surface, and a shank.

In some embodiments, a sole assembly for an article of footwear can include an outsole designed to engage with a ground surface and a midsole designed to receive a bottom portion of a wearer's foot. The outsole can be divided into a first portion located at a forefoot portion of the sole assembly and a second portion located at an arch portion of the sole assembly, the first portion being affixed to the midsole and the second portion being detached from the midsole. The second portion can be designed to contact the midsole in a compressed state due to an absorbed footwear load and is designed to form a gap between the second portion and the midsole when the absorbed footwear load is removed.

In some embodiments, a method of manufacturing an article of footwear can include positioning a shank designed to absorb footwear loads on top of an outsole designed to engage with a ground surface, positioning a midsole designed to receive a lower portion of a bottom portion of a user's foot on top of the shank and outsole, and securing the midsole to the outsole such that the shank is secured between the midsole and the outsole to form a sole assembly.

As should be apparent, the footwear described herein can provide a number of advantageous features and benefits. It is to be understood that in practicing the invention, an embodiment can be constructed to include one or more features or benefits of embodiments disclosed herein, but not others. Accordingly, it is to be understood that any illustrated embodiments are provided as examples and should not be construed as limiting, particularly since embodiments can be formed to practice the invention that do not include each of the features of the disclosed embodiments.

BRIEF DESCRIPTION OF THE DRAWINGS

The invention will be better understood from reading the description which follows and from examining the accompanying figures. These are provided solely as non-limiting examples of the invention.

DETAILED DESCRIPTION OF THE PREFERRED EMBODIMENTS

Reference will now be made in detail to the embodiments of the invention, examples of which are illustrated in the accompanying drawings.

Figure 1:
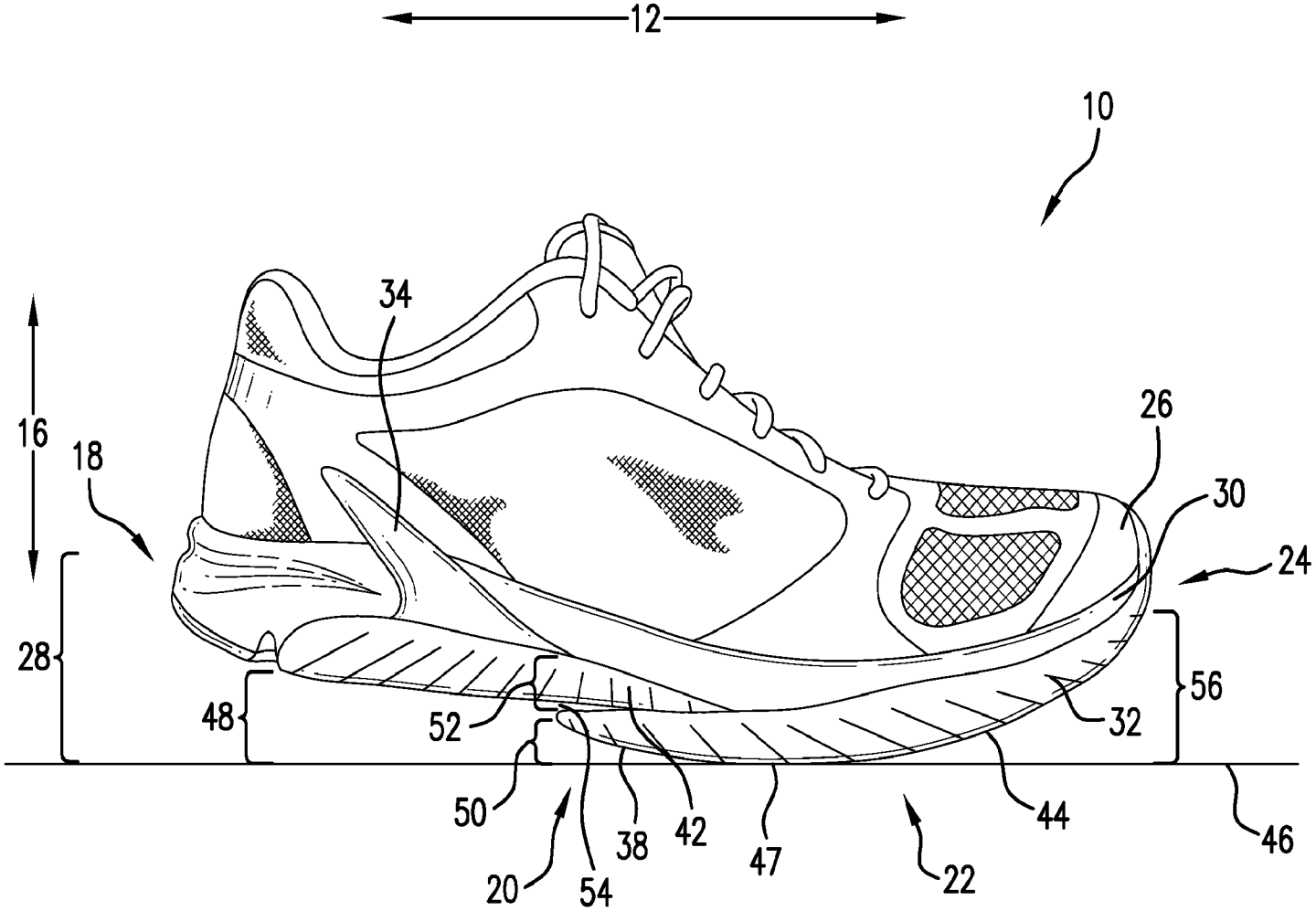
FIG. 1 is a side view of footwear according to an embodiment.

FIG. 1 is a side view of footwear 10 according to an embodiment. Footwear 10 can, for example, be in the form of an athletic shoe, such as a shoe designed for tennis, running, walking, basketball, or other activities. In some embodiments, footwear 10 can be in the form of a dress shoe, sandal, or another type of footwear.

Footwear 10 can extend in a longitudinal direction 12, lateral direction 14, and vertical direction 16, and can be divided into several portions, such as a heel portion 18, arch portion 20, forefoot portion 22, and toe portion 24, which corresponds to the portion of the wearer's foot within footwear 10. As described further herein, footwear 10 can be assembled from various pieces, such as an upper 26, and a sole assembly 28 that can include a midsole 30, an outsole 32, and a shank 34. The various parts of footwear 10 are described in further detail below.

Upper 26 can be designed to receive and secure an upper portion of a user's foot. Upper 26 can be attached directly or indirectly to one or more pieces of footwear 10, such as midsole 30 and/or outsole 32, and can be fabricated from various suitable materials, such as stitched fabric, leather, canvas, nylon, and/or other types of suitable natural or synthetic materials. Upper 26 can be made from a single material or a combination of materials. In some embodiments, upper 26 can include a lightweight and breathable engineered synthetic mesh. Upper 26 can additionally include a seam-free material that is welded to the breathable mesh to provide additional strength.

The particular activity for which the footwear is designed for can impact the material or materials used to construct upper 26. For example, a basketball shoe upper, a heavier material such as leather may be used, which in some cases can provide improved support to a wearer's foot and ankle than canvas or nylon. A running shoe upper, for example, might be formed of certain synthetic materials that are relatively lightweight, breathable, and/or easy to clean.

In some embodiments, upper 26 can further include one or more reflective patches or other reflective elements. In some embodiments, upper 26 can include one or more logos or other similar elements, which can for example be protected with a cover, such as a transparent or non-transparent thermoplastic polyurethane (TPU) cover.

Upper 26 can include laces to allow a wear to removably secure their foot within the footwear. In some embodiments, upper 26 can additionally or alternatively include latches, straps, or one or more other suitable fasteners.

Midsole 30 can be designed to cushion and/or receive a lower portion of a user's foot. In some embodiments, a foot receiving surface of midsole 30 can be substantially planar or can be contoured to the shape of a wearer's foot. Midsole 30 can, for example, be attached directly or indirectly to one or more pieces of footwear 10, such as upper 26, shank 34, and/or outsole 32, and can be made from a foam, such as ethylene vinyl acetate (EVA), polyester ethyl vinyl acetate (PEEVA), compression molded ethyl vinyl acetate (CMEVA), polyurethane, rubber, foamed rubber, or another suitable material or combination of materials. In some embodiments, footwear 10 can include a soft inner sole member, such as a sock liner, positioned between midsole 30 and the wearer's foot.

Outsole 32 can be designed to cushion a user's foot and/or engage with a ground surface 46. Outsole 32 can, for example, be directly or indirectly attached to one or more pieces of footwear 10, such as upper 26, shank 34, and/or midsole 30 and can be made from an abrasive-resistant material, such as a hard rubber. Outsole 32 can include a lateral outsole arm 38, a medial outsole arm 40 (shown, for example, in FIG. 7), and an outsole ramp portion 42 (shown, for example, in FIG. 7), which corresponds to and covers various components of shank 34 illustrated in FIGS. 2-5 and described in detail below.

As shown for example in FIG. 1, footwear 10 can balanced in an uncompressed state to lean forward with heel portion 18 lifted in the air. In some embodiments, this can be accomplished by including a curved bottom surface 44 of outsole 32 at forefoot portion 22. Footwear 10 can be weighted through a combination of elements such that footwear 10 is able to balance on a support surface, such as for example ground surface 46, by contact with a contact point 47 of curved bottom surface 44 of forefoot portion 22. This may present a visually appealing display at a retail location, for example, and can also serve to encourage a wearer to strike the footwear at a midfoot portion instead of at a heel portion. The midfoot portion is designed to be the lowest point of outsole 32 and therefore the first portion to strike. Due to shank 34 or another resilient member embedded in outsole 32, outsole 32 can compress and rebound back, thrusting the wearer forward into the forefoot, toe-off position. As such, outsole 32 can be designed to land in the midfoot portion and be assisted by outsole 32 into the toe-off position. In some embodiments, the radius of curvature of curved bottom surface 44 of outsole 32 is approximately 225 mm. The curved bottom outsole surface can extend an entire length of a forefoot portion and toe portion, or can only extend a portion thereof.

In such a balanced and uncompressed configuration, a gap 48 can be formed between heel portion 18 of outsole 32 and ground surface 46 to allow footwear 10 to rotate to or from heel portion 18 during a step. In some embodiments, gap 48 can be approximately 25 mm. Another gap 50 can be formed between a distal end of outsole arm 38 and ground surface 46 to allow outsole arm 38 to rotate along curved bottom surface 44 while keeping contact with ground surface 46 during a step. Another gap 52 can be formed between the distal end of outsole arm 38 and midsole 30 to allow outsole arm 38 to flex towards midsole 30 during a step. In some embodiments, gap 52 can be greater than 10 mm. In some embodiments, gap 52 is approximately 11 mm. Another gap 54 can be formed between the distal end of outsole arm 38 and outsole ramp portion 42 to allow outsole arm to flex towards outsole ramp portion 42 during a step. Another gap 56 can be formed between toe portion 24 and ground surface 46 to allow footwear 10 to rotate to or from toe portion 24 during a step.

In some embodiments, outsole 32 can be divided into a first portion located at forefoot portion 22 of sole assembly 28 and a second portion (which can, for example, correspond to lateral outsole arm 38 and medial outsole arm 40) located at arch portion 20 of sole assembly 28. As shown for example in FIG. 1, the first portion is affixed to midsole 30 and the second portion is detached from midsole 30. The second portion can be designed to contact midsole 30 in a compressed state due to an absorbed footwear load, and can be designed to form a gap (such as gap 52, described above) between the second portion and midsole 30 when the absorbed footwear load is removed. In some embodiments, the second portion is able to elastically flex through the use of a resilient member (such as for example one or more of the shanks described herein) that is disposed between outsole 32 and midsole 30.

Figure 2:
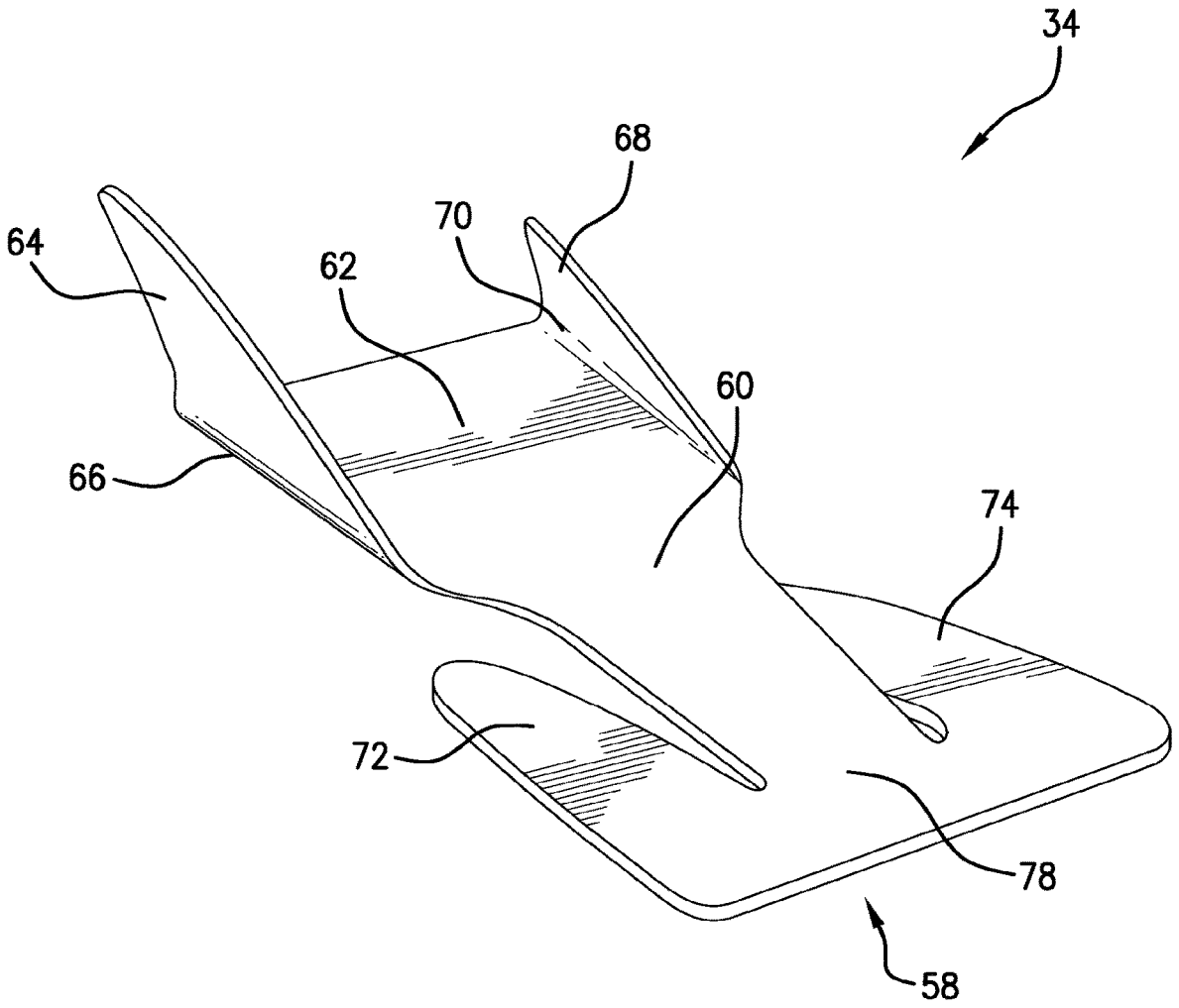
FIG. 2 is a perspective view of a shank for the footwear of FIG. 1 in an uncompressed state according to an embodiment.
Figure 3:
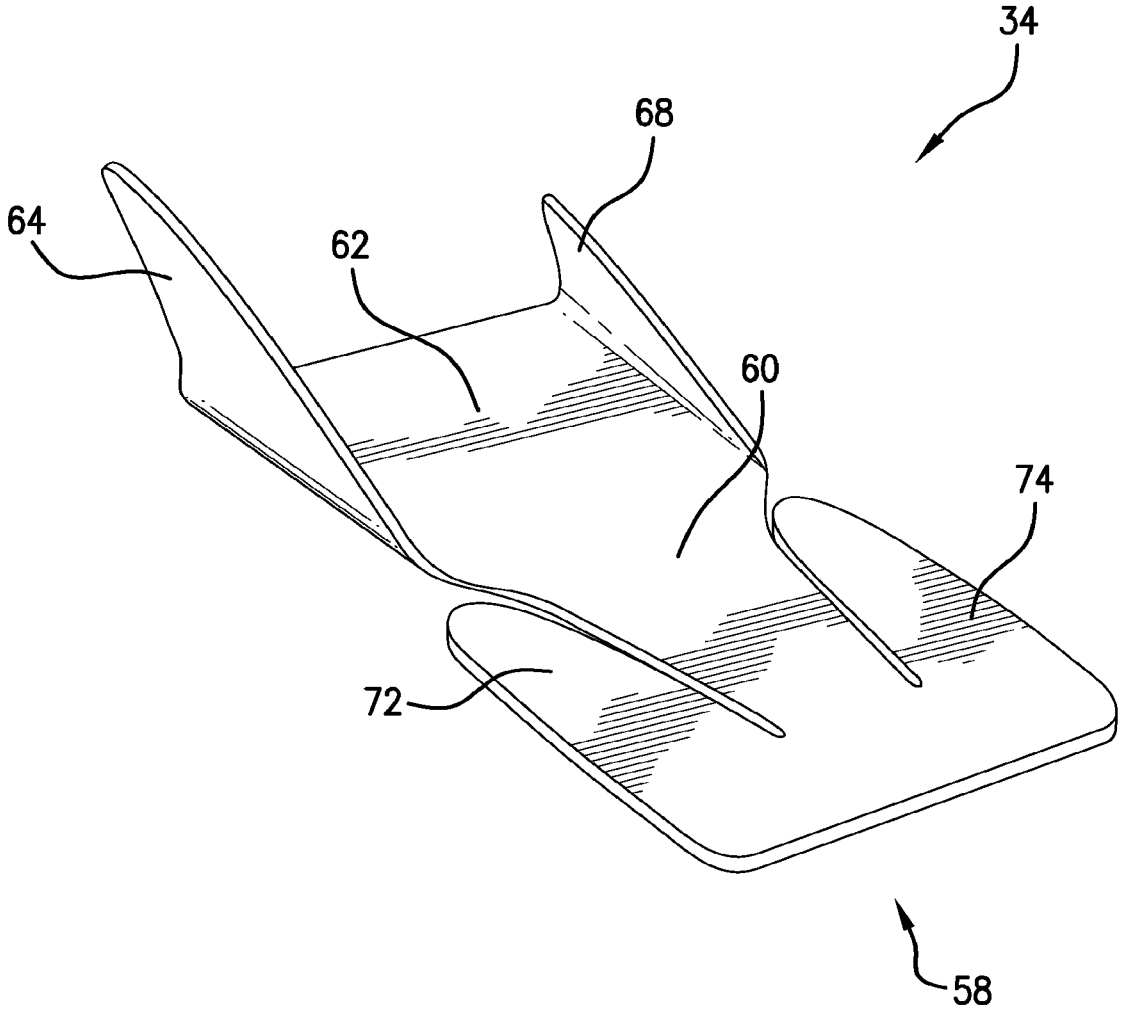
FIG. 3 is a perspective view of the shank of FIG. 2.
Figure 4:
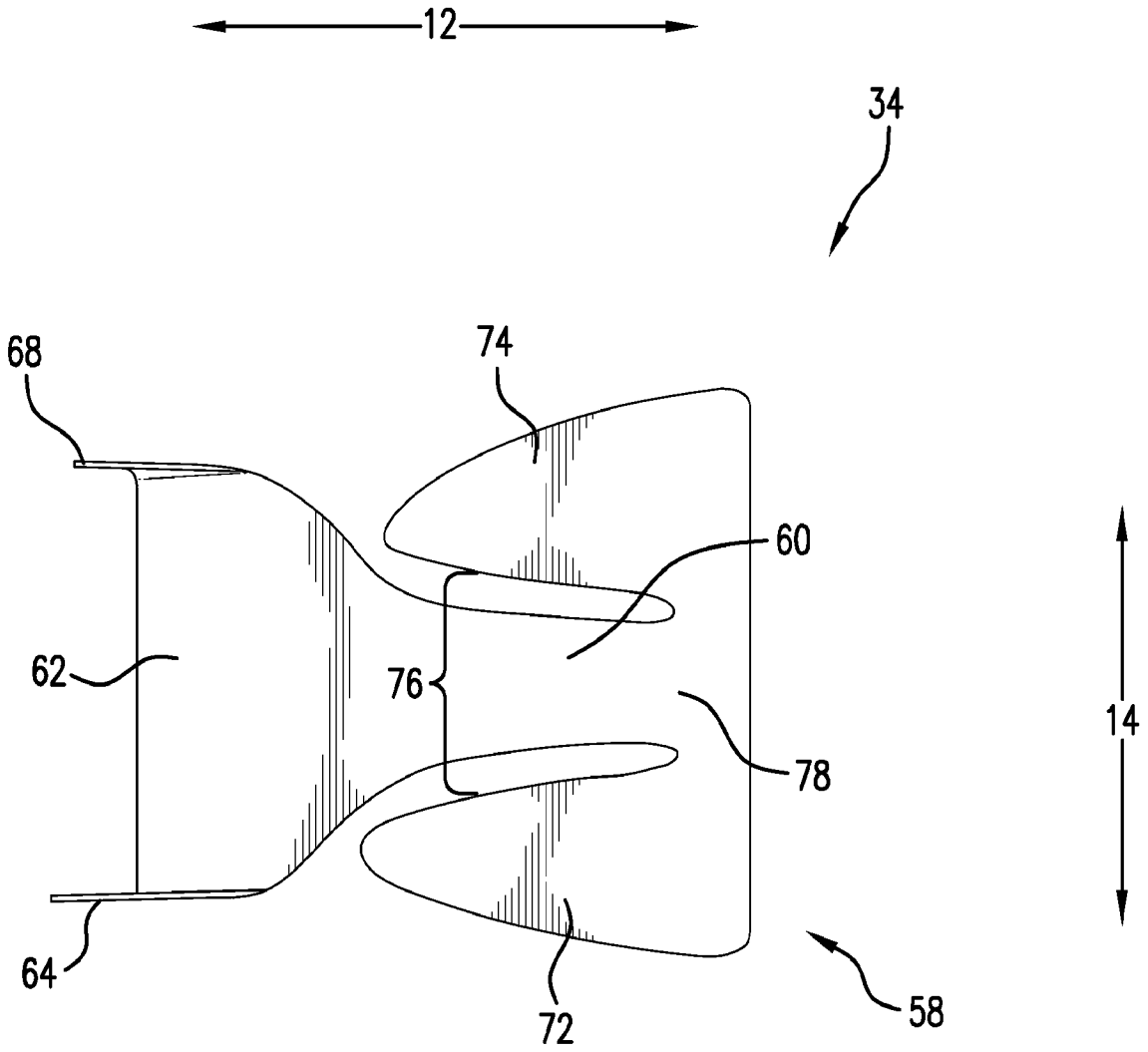
FIG. 4 is a top view of the shank of FIG. 2.
Figure 5:
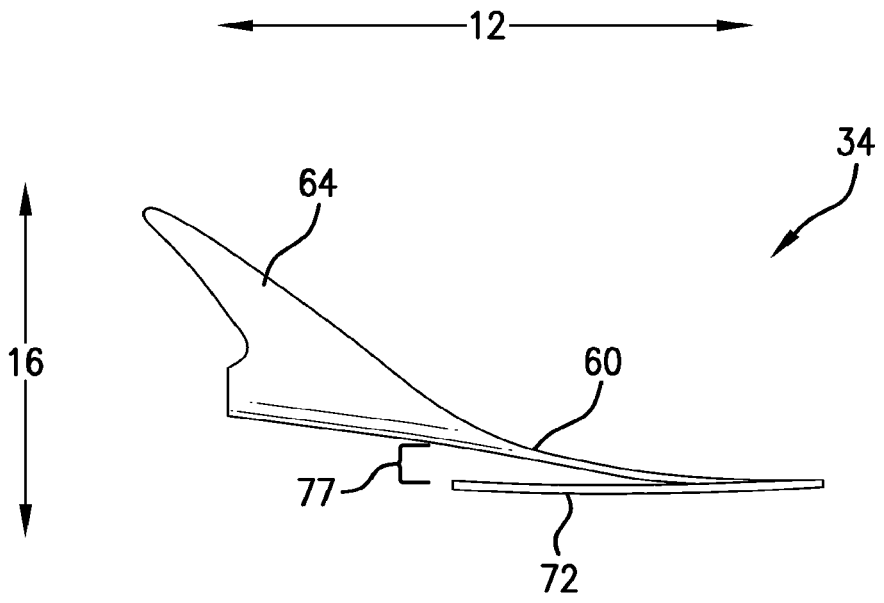
FIG. 5 is a side view of the shank of FIG. 2.

FIGS. 2-5 illustrate several views of shank 34 for footwear 10. In particular, FIG. 2 is a perspective view of shank 34 in an uncompressed state, FIG. 3 is a perspective view of shank 34 in a compressed state, FIG. 4 is a top view of shank 34, and FIG. 5 is a side view of shank 34. As shown in FIG. 5, for example, a gap 77 can be formed between shank arms 72 and 74 and ramp portion 60 in a vertical direction 16 in an uncompressed state.

In some embodiments, shank 34 can be designed to elastically absorb footwear loads, provide a propulsive spring energy when compressed, and/or provide structural rigidity to footwear 10. Shank 34 can include a plurality of substantially planar portions, some or all of the portions having a uniform thickness. For example, in some embodiments, the thickness of one or more portions of shank 34 can be approximately 1.5 mm.

Shank 34 can be designed to elastically deform under absorbed footwear loads. For example, in some embodiments, such as the embodiment shown in FIGS. 2-5, shank 34 is designed such that it exhibits a spring effect in the longitudinal and vertical directions (12, 16) to facilitate forward movement. In some embodiments, shank 34 can be designed such that it provides exhibit a spring effect in the lateral and vertical directions (14, 16) to facilitate side-to-side movement, which can be desirable for activities requiring a lot of side-to-side movement, such as tennis for example.

As shown for example in the embodiment of FIG. 2, shank 34 can include a substantially planar base portion 58 extending within a first plane in the longitudinal and lateral directions (12, 14). Shank 34 further includes a substantially planar ramp portion 60 designed to absorb footwear loads in vertical direction 16. Ramp portion 60 is arranged to extend, in an uncompressed state (shown for example in FIG. 2), within a second plane that is oblique to the plane formed by lateral shank arm 72, medial shank arm 74, and other portions of base portion 58. The second plane can, for example, be a rotated version of the first plane around an axis in one of the longitudinal, lateral, and vertical directions (12, 14, 16) extending from a hinge portion, such as neck portion 78. For example, as shown in FIG. 2, the second plane of shank 34 is a rotated version of the first plane around an axis in lateral direction 14 extending from neck portion 78.

Base portion 58 can be positioned within footwear 10 at a corresponding forefoot portion 22 such that ramp portion 60 is positioned at a corresponding arch portion 20 of footwear 10. Such a configuration can serve to encourage a mid-foot strike by the wearer and in some embodiments can allow footwear 10 to balance with heel portion 18 raised above ground surface 46, as shown for example in FIG. 1.

In some embodiments, base portion 58 can include a first substantially planar shank arm 72 and a second substantially planar medial shank arm 74, which can respectively correspond to a lateral side and medial side of footwear 10. Both shank arms 72 and 74 can be laterally offset from ramp portion 60 and can extend within a plane formed by base portion 58 towards a longitudinal distal direction away from base portion 58. In some embodiments, first shank arm 72 can be located on an lateral side of ramp portion 60 opposite from second shank arm 74. Such a configuration can, for example, provide improved stability for shank 34 and footwear 10 and/or can reduce pronation of footwear 10 during use.

Base portion 58 and ramp portion 60 can be arranged such that they do not overlap in vertical direction 16. For example, as shown in the top view of shank 34 in FIG. 4, lateral shank arm 72 and medial shank arm 74 are laterally offset to form a gap 76 therebetween. Ramp portion 60 is disposed within gap 76 such that base portion 58 (including lateral shank arm 72 and medial shank arm 74), does not overlap with ramp portion 60 in vertical direction 16. In some embodiments, and as shown for example in FIG. 3, ramp portion 60 can be designed to deform into a compressed state (shown for example in FIG. 3) due to absorbed footwear loads such that ramp portion 60 is substantially coplanar to base portion 58. In some embodiments, ramp portion 60 can be designed to substantially return to the uncompressed state when the footwear load is removed.

Shank 34 can include a neck portion 78 connecting ramp portion 60 to base portion 58. Neck portion 78 can, for example, be designed to flex to allow ramp portion 60 to deform from the uncompressed state to the compressed state. As such, neck portion 78 can serve as a flexure hinge for shank 34.

In some embodiments, shank 34 can include a flared landing portion 62 extending from a distal end of ramp portion 60. Landing portion 62 can include a lateral flap portion 64 extending from bend 66 and a medial flap portion 68 extending from bend 70. Lateral flap portion 64 and medial flap portion 68 can extend substantially in longitudinal and vertical directions (12, 16). Lateral flap portion 64 can be positioned to correspond to a lateral side of a user's foot, and medial flap portion 68 can be positioned to correspond to a medial side of the user's foot, one or both flap portions 64, and 68 can be designed to provide lateral support to footwear 10 or another function.

Shank 34 can be made of a suitable carbon fiber, metal, fiberglass, plastic, or another suitable material. In some embodiments, shank 34 is made of multiple different materials, such as, for example, a first material overlaying a second material, or a first portion of shank 34 being a first material and a second portion of shank 34 being a second material. One or more portions of shank 34 can be made of a single piece of material or multiple pieces of materials. For example, base portion 58, ramp portion 60, neck portion 78, lateral shank arm 72, and medial shank arm 74 can all be a single unitary piece of material.

Figure 6:
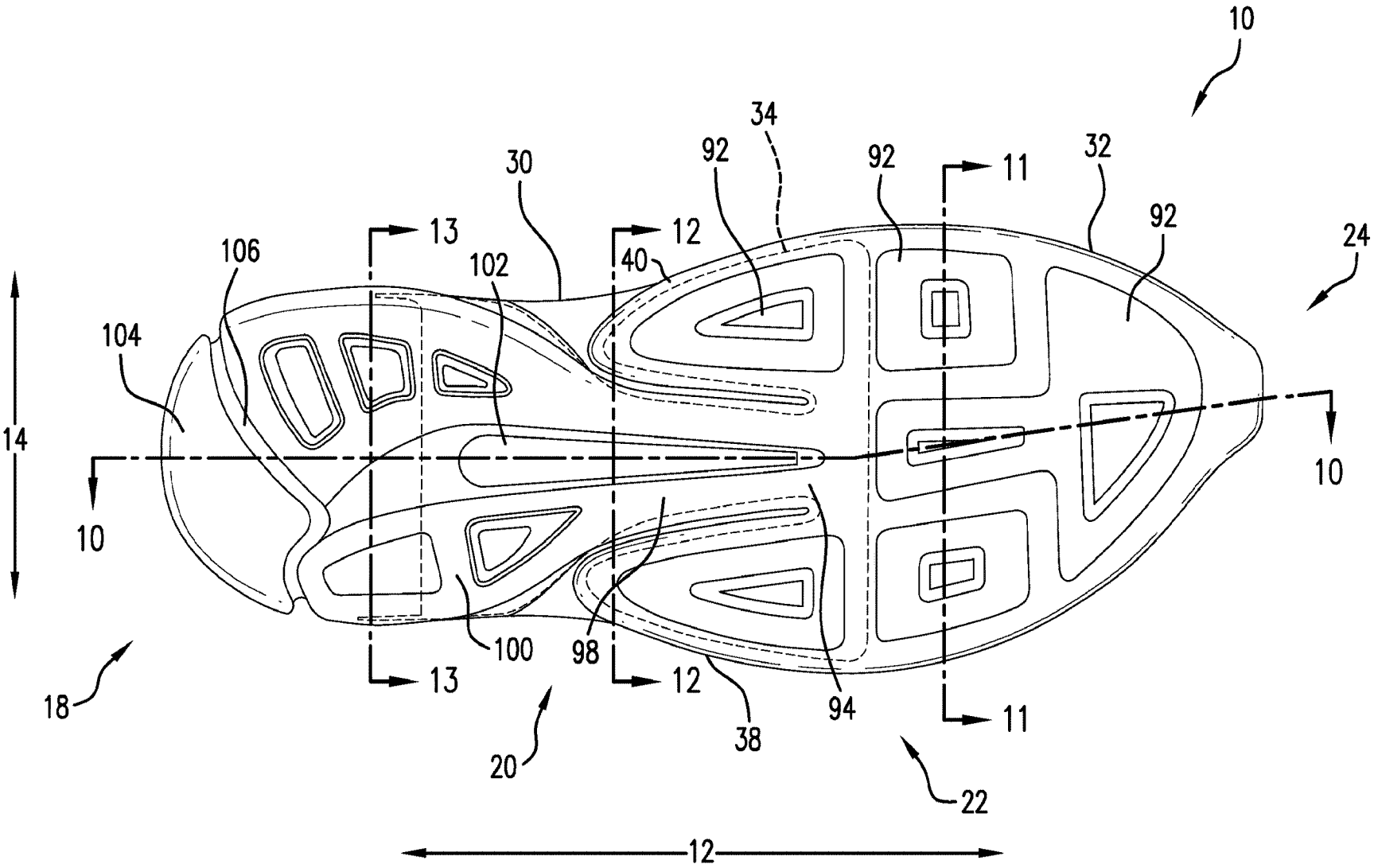
FIG. 6 is a bottom view of the footwear of FIG. 1.
Figure 7:
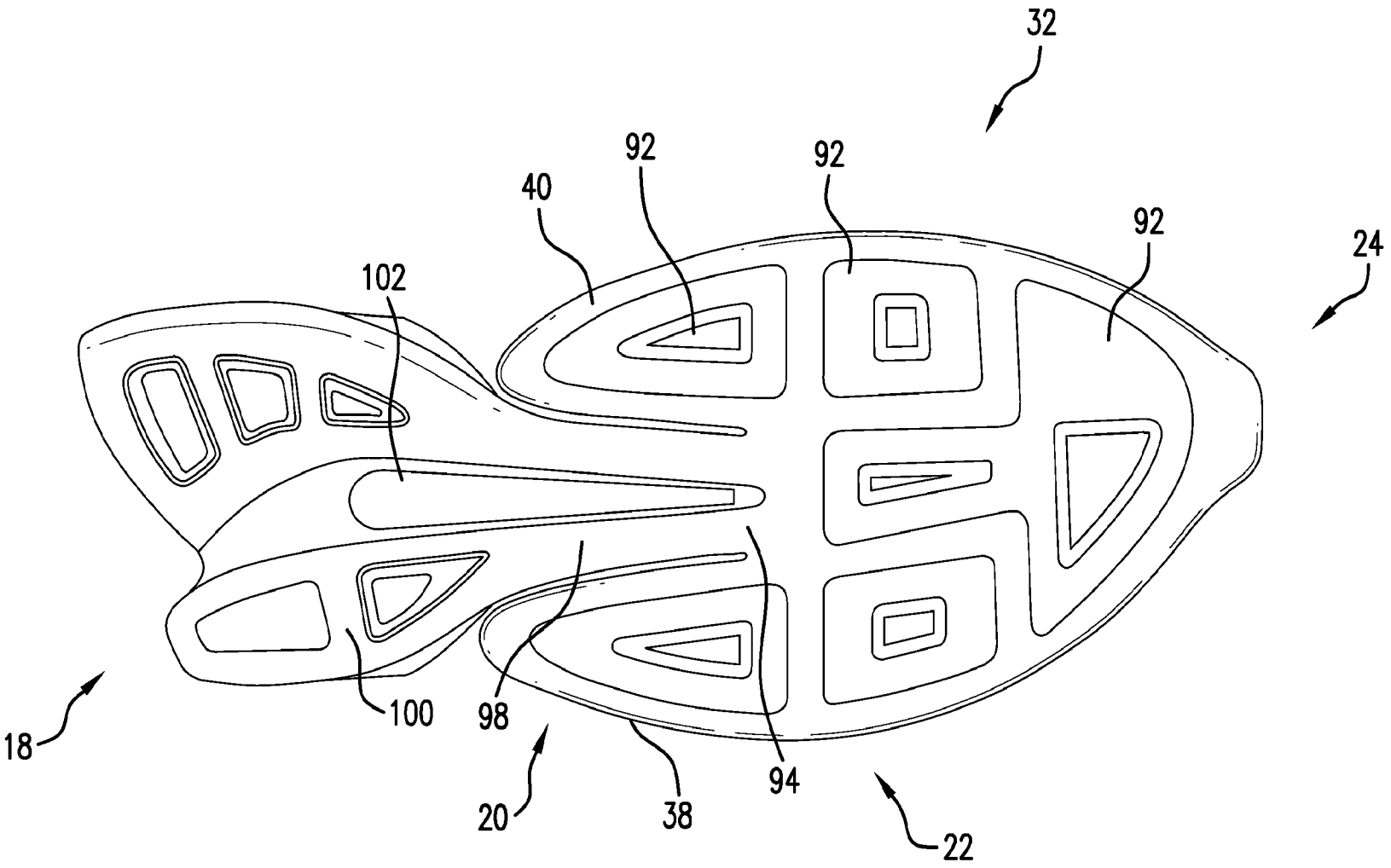
FIG. 7 is a bottom view of an outsole for the footwear of FIG. 1.
Figure 8:
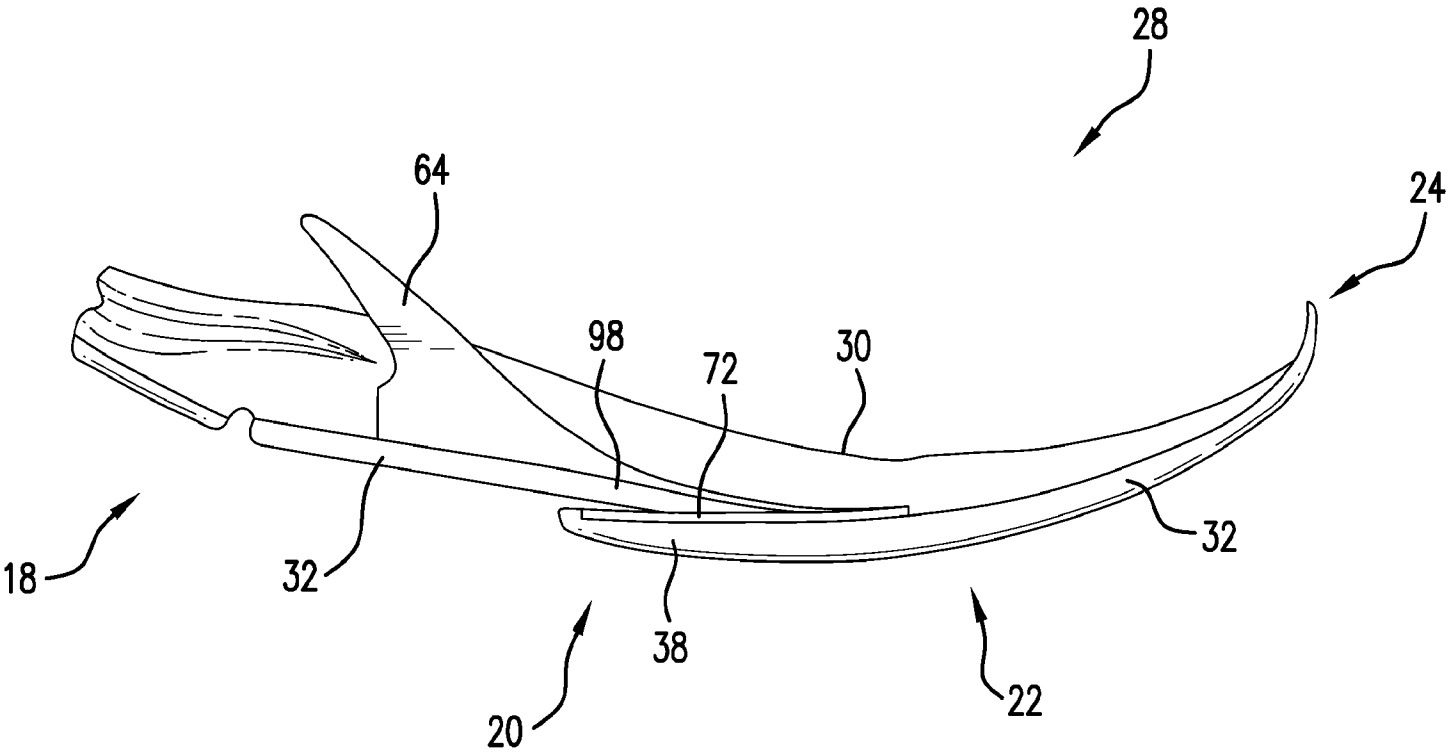
FIG. 8 is a lateral side view of a sole assembly for the footwear of FIG. 1.

FIGS. 6-8 illustrate bottom views of footwear 10. In particular, FIG. 6 illustrates a bottom view of sole assembly 28 including outsole 32 and midsole 30, and FIG. 7 illustrates a bottom view of outsole 32 with midsole 30 removed for clarity. Shank 34 is shown in broken lines in FIG. 6 to indicate its location within sole assembly 28.

To provide a desired traction for footwear 10, outsole 32 can include geometries of protrusions and/or recessions designed to increase friction between outsole 32 and ground surface 46. Such geometries can, for example, be chosen based on the particular activities that footwear 10 is designed or expected to be used for. For example, outsole 32 can include one or more treads 92 protruding therefrom. Treads 92 can for example be formed from die-cut blown rubber, carbon rubber, or other suitable materials. As shown in FIG. 6, outsole 32 includes an outsole neck portion 94 corresponding to shank neck portion 96, an outsole ramp portion 98 corresponding to shank ramp portion 60, and a flared outsole landing portion 100 corresponding to landing portion 62 of shank 34.

Outsole 32 can further include one or more grooves for improved traction, ornamentation, weight reduction, ventilation, or other purposes. For example, outsole 32 can include groove 102 formed within outsole ramp portion 98. In some embodiments, groove 102 can be formed within outsole 32 such that groove 102 reveals a bottom surface of shank 34 (as shown for example in FIG. 6) or another piece of sole assembly 28. Outsole 32 can include one or more distinct pieces such as an outsole heel portion 104 separated from the rest of outsole 32 by a groove 106. Groove 106 can be formed within outsole 32 such that groove 106 reveals a bottom surface of midsole 30.

Figure 9:
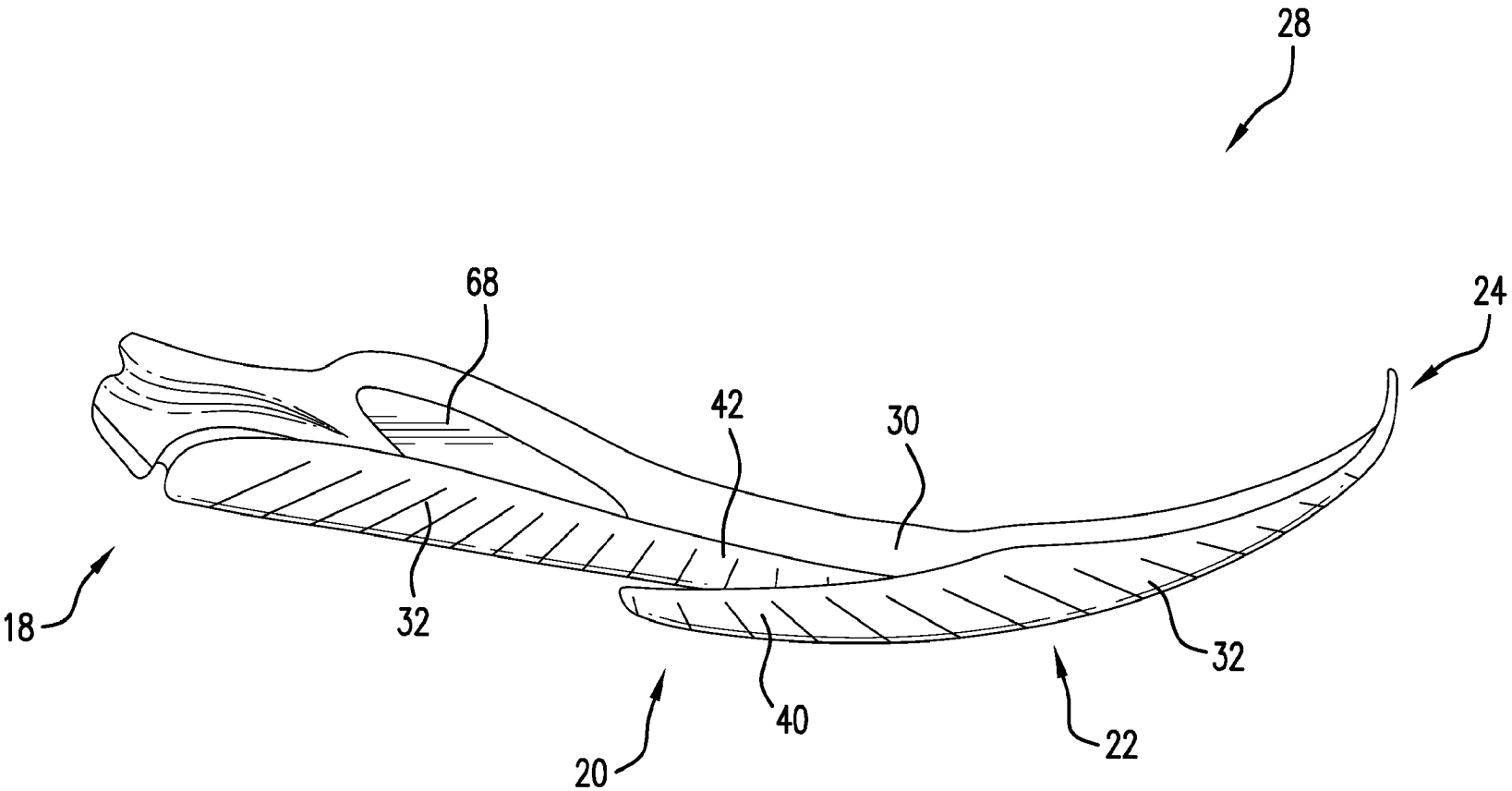
FIG. 9 is a medial side view of the sole assembly of FIG. 8.
Figure 10:
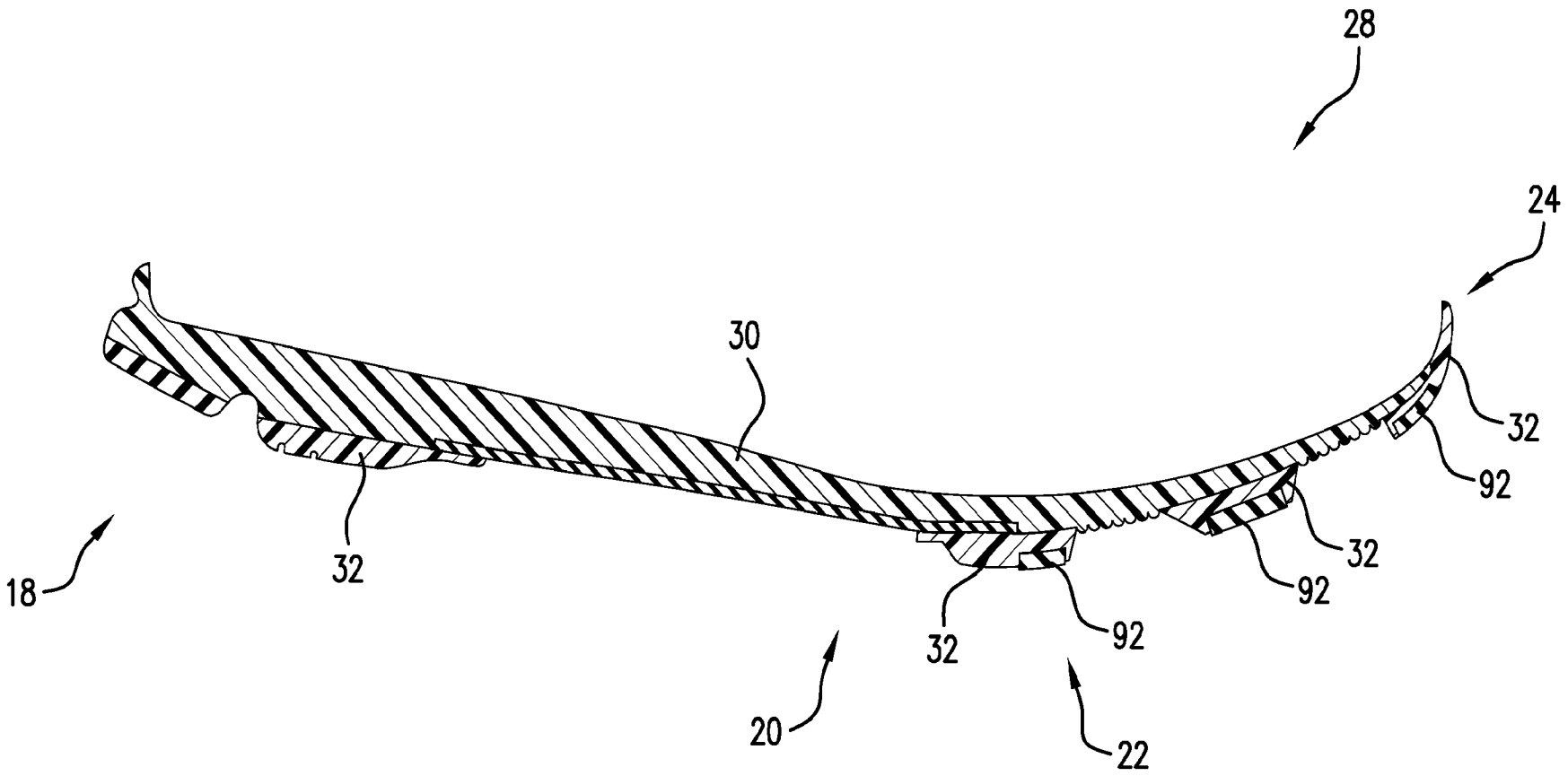
FIG. 10 is a cross-sectional view of the sole assembly of FIG. 8 along line 10-10 of FIG. 6.
Figure 11:
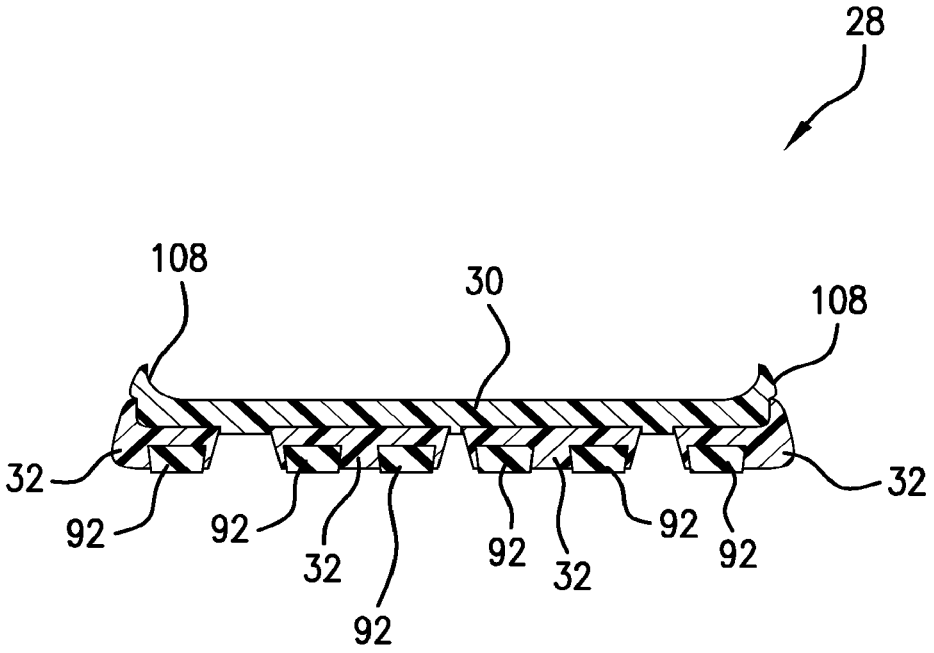
FIG. 11 is a cross-sectional view of the sole assembly of FIG. 8 along line 11-11 of FIG. 6.
Figure 12:
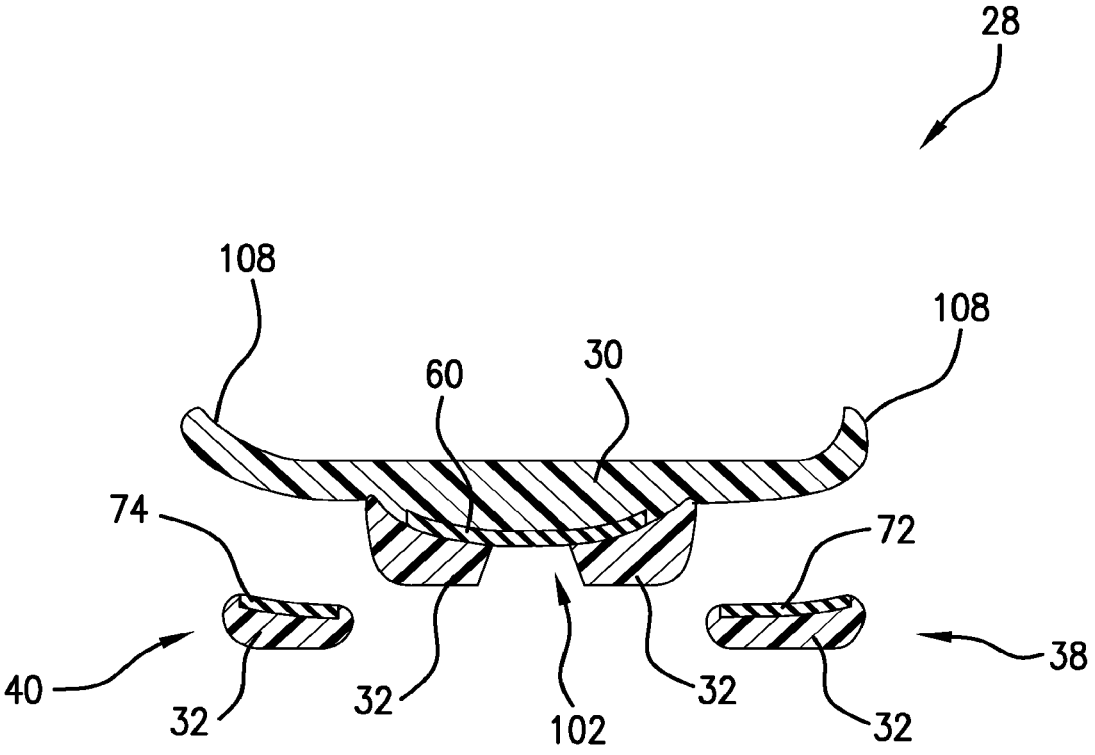
FIG. 12 is a cross-sectional view of the sole assembly of FIG. 8 along line 12-12 of FIG. 6.
Figure 13:
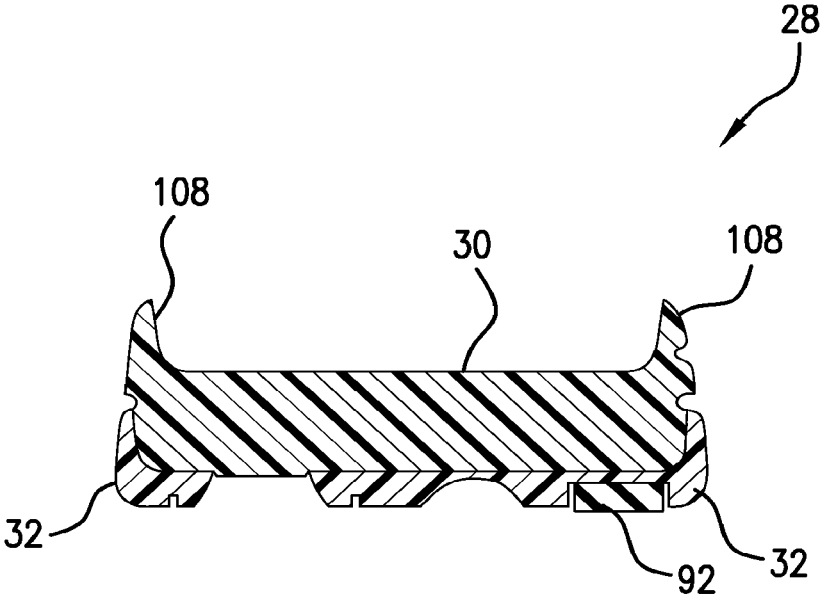
FIG. 13 is a cross-sectional view of the sole assembly of FIG. 8 along line 13-13 of FIG. 6.

FIGS. 8-13 illustrate various partially transparent and sectional views of sole assembly 28. In particular, FIG. 8 is a lateral side view of sole assembly 28 with a portion of outsole 32 illustrated as partially transparent, FIG. 9 is a medial side view of sole assembly 28, FIG. 10 is a cross-sectional view of forefoot portion 22 of sole assembly 28 along line 10-10 of FIG. 6, FIG. 11 is a cross-sectional view of arch portion 20 of sole assembly 28 along line 11-11 of FIG. 6, FIG. 13 is a cross-sectional view of heel portion 18 of sole assembly 28 along line 13-13 of FIG. 6.

Figure 14:
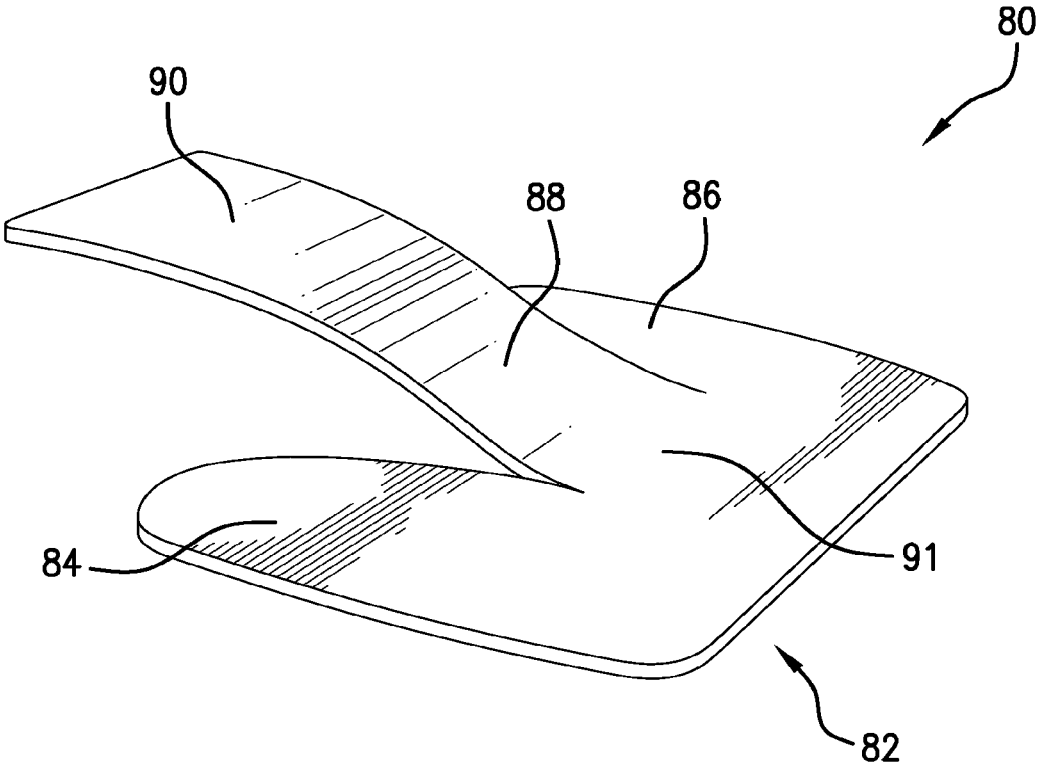
FIG. 14 is a perspective view of a shank according to another embodiment.

As shown for example in FIGS. 12-14, midsole 30 can include one or more peripheral ridges 108. Ridges 108 can extend upwards in a vertical direction from midsole 30 and can, for example, be designed to provide lateral improved support for footwear 10, an improved attachment surface for upper 26, and/or other functions. The height of ridge 108 can vary in longitudinal direction 12. As shown for example in FIG. 12, one or more portions of shank 34, such as ramp portion 60, can be substantially planar but with a slight curvature due to absorbed footwear loads or can be designed to have a slight curvature in an uncompressed state. As would be understood by those skilled in the art, in compression, elements 32 of the outsole shown in FIG. 12 move toward and then contact midsole 30 to have a relationship similar to that illustrated in FIG. 11.

FIG. 14 is a perspective view of another embodiment of a shank 80. Shank 80 includes a base portion 82 including a lateral shank arm 84 and medial shank arm 86. Shank 80 includes ramp portion 88 extending at an oblique angle to base portion 82. Unlike shank 34 shown in FIG. 2, shank 80 does not include lateral and medial shank flap portions. As shown for example in FIG. 6, a landing portion 90 formed in ramp portion 88 can be curved from the angle of ramp portion 88 to provide a flat and substantially horizontal surface for receiving a wearer's foot. Shank 80 can include a neck portion 91 connecting ramp portion 88 to base portion 82.

Figure 15:
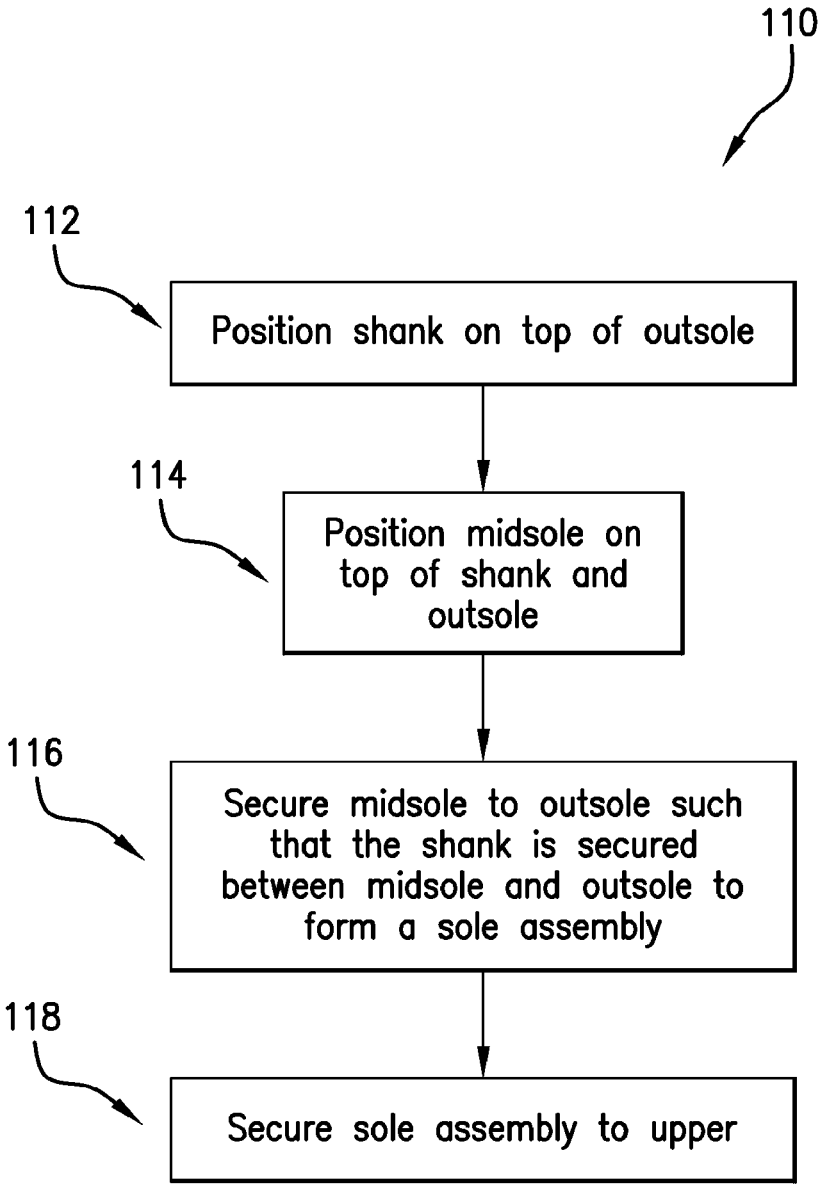
FIG. 15 is a flowchart for a method of manufacturing footwear according to an embodiment.

FIG. 15 is a flowchart illustrating a method 110 of manufacturing footwear, with reference to the pieces of footwear 10 described herein. Method 110 can include positioning shank 34 on top of outsole 32 (step 112). Next, midsole 30 is positioned on top of shank 34 and outsole 32 (step 114). Next, midsole 30 is secured to outsole 32 such that shank 34 is secured between midsole 30 and outsole 32 to form sole assembly 28 (step 116). Next, sole assembly 28 is secured to upper 26 (step 118). The steps of securing one or more components of footwear 10 can be performed using adhesives, heat and pressure cycles and operations, and/or other suitable attachment processes. In some embodiments, method 110 can include forming ramp portion 60 of shank 34 using a pressing operation. In some embodiments, shank flap portions 64 and 68 can be formed using a single pressing operation that also forms ramp portion 60, or can be formed using a second pressing operation, or another suitable operation. The steps described herein can be performed in any suitable order, and additional or equivalent steps can be included before, during, or after the steps described herein. For example, in some embodiments, upper 26 can be secured to midsole 30 before securing shank between midsole 30 and outsole 32.

The choice of materials for the parts described herein can be informed by the requirements of cost, aesthetics, mechanical properties, temperature sensitivity, biocompatibility, moldability properties, or any other factor apparent to a person having ordinary skill in the art. For example, one or more parts of footwear 10 can be made of a polymer, gel structure, foam structure, and/or a stiffer support structure, such as carbon fiber that provides desired softness, flexibility and shock absorbing properties.

Further, it should be appreciated that the exemplary embodiments of the invention are not limited to the exemplary footwear shown and described herein. Although this invention has been described in conjunction with exemplary embodiments outlined herein, various alternatives, modifications, variations and/or improvements, whether known or that are, or may be, presently unforeseen, may become apparent. Accordingly, the exemplary embodiments of the footwear, described herein are intended to be illustrative, not limiting. The various changes may be made without departing from the spirit and scope of the invention.

The drawings and the foregoing description are not intended to represent the only form of the invention in regard to the details of its construction and manner of operation. In fact, it will be evident to one skilled in the art that modifications and variations may be made without departing from the spirit and scope of the invention. Changes in form and in the proportion of parts, as well as the substitution of equivalents, are contemplated as circumstances may suggest or render expedient; and although specific terms have been employed, they are intended in a generic and descriptive sense only and not for the purpose of limitation, the scope of the invention being delineated in the following claim set.

Further, the purpose of the foregoing Abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The Abstract is not intended to be limiting as to the scope of the present invention in any way.

The invention claimed is:

1. An article of footwear extending in a longitudinal, lateral, and vertical direction, the article of footwear comprising:

a heel portion, an arch portion, a forefoot portion, and a toe portion, wherein the arch portion extends between the heel portion and the forefoot portion in the longitudinal direction and the forefoot portion extends between the arch portion and the toe portion in the longitudinal direction;

a midsole;

an outsole configured to engage with a ground surface;

a shank configured to absorb footwear loads on top of the outsole;

wherein the outsole comprises a first portion and a second portion, and wherein the first portion is located at the forefoot portion of the article, and the second portion extends rearwardly from the first portion to a first location that is in the arch portion of the article, such that the second portion terminates at the first location in the arch portion;

wherein the second portion is configured to contact the midsole at the arch portion of the article in a compressed state due to an absorbed footwear load, and is configured to form a gap between the second portion and the midsole at the arch portion of the article in an uncompressed state when the absorbed footwear load is removed;

wherein the heel portion is configured to contact the ground surface without the second portion extending between the heel portion and the ground surface;

wherein the shank comprises a base portion and a ramp portion, and the base portion is movable relative to the ramp portion as the article is changed from the compressed state to the uncompressed state, and at least part of the base portion is coupled to the second portion of the outsole and moves with the outsole as the article is changed from the compressed state to the uncompressed state; and at least part of the ramp portion is coupled to the midsole, wherein in the uncompressed state the at least part of the base portion coupled to the second portion of the outsole is below the gap and the at least part of the ramp portion coupled to the midsole is above the gap.

2. The article of footwear of claim 1, wherein the base portion extends within a first plane in the longitudinal and lateral directions in the uncompressed state, and the ramp portion extends within a second plane that is oblique to the first plane in the uncompressed state.

3. The article of footwear of claim 2, wherein the ramp portion is substantially parallel to the base portion in the compressed state.

4. The article of footwear of claim 2, wherein the ramp portion includes a neck portion that connects the ramp portion to the base portion, the neck portion being designed to flex to allow the ramp portion to deform from the uncompressed state to the compressed state.

5. The article of footwear of claim 2, wherein the shank comprises a landing portion extending from the ramp portion, wherein the landing portion extends in the second plane in the uncompressed state.

6. The article of footwear of claim 1, wherein a forefoot portion of the outsole includes a curved bottom surface, and the article of footwear is weighted such that in an uncompressed state, the article of footwear is able to balance on a support surface by contact with only the curved bottom surface of the forefoot portion and without support from the arch portion or the heel portion.

7. The article of footwear of claim 1, wherein the midsole is made from a foam; the outsole is made from an abrasive-resistant material; and the shank is made from a carbon fiber, a metal, a fiberglass, a plastic or a combination thereof.

8. The article of footwear according to claim 1, wherein the gap between the first location of the second portion of the outsole and the midsole is a first gap, and wherein the first gap is present on a medial side of the article, and further wherein when the article is in an uncompressed state a second gap is formed between a second location of the second portion of the outsole and the midsole, and wherein said second gap is present on a lateral side of the article; and wherein said second portion of the outsole includes a lateral outsole arm and a medial outsole arm, wherein said lateral and medial outsole arms are spaced from each other in a lateral direction, wherein the first gap is above the medial outsole arm and the second gap is above the lateral outsole arm.

9. An article of footwear comprising a sole assembly which includes a heel portion, an arch portion, a forefoot portion, and a toe portion, wherein the sole assembly further comprises:

a midsole;

an outsole configured to engage with a ground surface;

a shank configured to absorb footwear loads on top of the outsole;

wherein the outsole comprises a first portion and a second portion, and wherein the first portion is located at a forefoot portion of the sole assembly, and the second portion extends rearwardly from the first portion to a first location that is in the arch region of the sole assembly, such that second portion terminates at the first location in the arch region;

wherein the first portion is affixed to the midsole and the second portion is detached from the midsole at the arch portion of the sole assembly;

wherein the heel portion is configured to contact a ground surface without the second portion extending between the heel portion and the ground surface;

wherein the shank comprises a base portion and a ramp portion, and the base portion is movable relative to the ramp portion as the sole assembly is changed from a compressed state to an uncompressed state;

wherein at least part of the base portion is coupled to the second portion of the outsole and moves with the outsole as the sole assembly is changed from the compressed state to the uncompressed state, and wherein at least part of the ramp portion is coupled to the midsole, and in a side view the at least part of the ramp portion is above the at least part of the base portion in the uncompressed state; and wherein the second portion is configured to contact the midsole at the arch portion of the sole assembly in the compressed state due to an absorbed footwear load, and is configured to form a gap between the second portion and the midsole in the uncompressed state at the arch portion of the sole assembly when the absorbed footwear load is removed, and wherein in the uncompressed state the at least part of the base portion of the shank is below the gap and the at least part of the ramp portion is above the gap.

10. The article of footwear of claim 9, wherein the base portion extends within a first plane in a longitudinal direction and lateral direction in the uncompressed state, and the ramp portion extends within a second plane that is oblique to the first plane in the uncompressed state.

11. The article of footwear of claim 10, wherein the ramp portion is substantially coplanar parallel to the base portion in the compressed state.

12. The article of footwear of claim 9, wherein the ramp portion includes a neck portion that connects the ramp portion to the base portion, the neck portion being designed to flex to allow the ramp portion to deform from the uncompressed state to the compressed state.

13. The article of footwear of claim 9, wherein the base id ramp portion are a single piece of material.

* * * * *